US007308723B2

(12) United States Patent
Nunokawa

(10) Patent No.: US 7,308,723 B2
(45) Date of Patent: Dec. 18, 2007

(54) HOT BATH FACILITY AND TEMPERATURE AND HUMIDITY CONTROL METHOD THEREFOR

(76) Inventor: Toshihiro Nunokawa, 1-119-6, Higashi-odori 1-chome Yamagata, Yonezawa (JP) 992-0024

( * ) Notice: Subject to any disclaimer, the term of this patent is extended or adjusted under 35 U.S.C. 154(b) by 496 days.

(21) Appl. No.: 10/940,897

(22) Filed: Sep. 14, 2004

(65) Prior Publication Data

US 2005/0072101 A1 Apr. 7, 2005

(30) Foreign Application Priority Data

Sep. 19, 2003 (JP) ..... 2003-329111

(51) Int. Cl.
*A61H 33/06* (2006.01)

(52) U.S. Cl. ..... 4/524; 165/53

(58) Field of Classification Search ..... 165/49, 165/50, 53, 56, 171; 4/524; 432/31; 219/213, 219/548; 52/302.3, 220.2, 220.3; 392/432, 392/435

See application file for complete search history.

(56) References Cited

U.S. PATENT DOCUMENTS 4,011,989 A * 3/1977 Diggs ..... 165/56
4,301,859 A * 11/1981 Hollemann ..... 165/49
4,979,373 A * 12/1990 Huppee ..... 165/171
5,097,893 A * 3/1992 Trimble ..... 165/46

FOREIGN PATENT DOCUMENTS

JP 8-12406 A 1/1996
JP 2001-95889 A 4/2001

* cited by examiner

*Primary Examiner*—Tuan Nguyen
(74) *Attorney, Agent, or Firm*—Lerner, David, Littenberg, Krumholz & Mentlik, LLP

(57) ABSTRACT

There is provided a hot bath facility (1) configured so that pipes (41) and (4) of two stages, upper and lower, are laid above floor concrete (3) in an enclosed bathroom (2), a training wave concrete layer (5) is formed above the pipes via a protective concrete layer (43), a rough stone flat plate (52) generating training wave energy is embedded in an appropriately divided space (51) substantially in a flush form, and on the other hand, into pipes (41, 4) of two stages, upper and lower, hot water can be supplied circulatingly from respective dedicated boilers (44, 45)

10 Claims, 5 Drawing Sheets

HOT BATH FACILITY AND TEMPERATURE AND HUMIDITY CONTROL METHOD THEREFOR

BACKGROUND OF THE INVENTION AND RELATED ART STATEMENT

1. Field of the Invention

The present invention relates to a hot bath facility and a temperature and humidity control method therefor. The technical field of the present invention includes all fields relating to a hot bath facility, including not only a field of building and construction for building the facility but also all fields generally called industrial machinery, for example, the manufacture and sales of equipment and apparatuses needed in the facility, especially equipment and apparatuses relating to hot baths, the supply of materials and parts, such as lumber, concrete, natural stone, metals, and plastics, necessary for the equipment and apparatuses, the supply of machines and tools necessary for fabrication of these materials and parts, the supply of raw materials, such as lumber, plywood, plastics, and various metallic materials, necessary for the materials, machinery, and parts, a field of electronic parts incorporated in the equipment and apparatuses and control equipment manufactured by integrating these electronic parts, a field of various types of measuring instruments, a field of power machinery for driving the equipment and apparatuses, and a field of electricity and oil which are energy sources for operating the equipment and apparatuses. Furthermore, the technical field includes the fields relating to testing, research, display, sales, import and export, and usage of the equipment and apparatuses, fields relating to recovery and transportation for recovering and transporting refuse generated by the operation of the equipment and apparatuses, the field relating to recycling for efficiently recycling the refuse, and new fields which relate to a hot bath but cannot be anticipated at present.

2. Description of Related Art (Viewpoint)

A bedrock bath, in which a rush mat or towel is spread out on bedrock warmed by terrestrial heat, and a person lies down thereon to warm his/her body, is recognized to be effective in promoting health and improving physical constitution because the body is warmed by heat, electromagnetic waves, etc. transferred from the bedrock, by which waste matters, toxins, and the like in the body can be expelled together with a large amount of sweat. However, natural bedrock which is kept at a temperature suitable for a bedrock bath and effective in promoting health exists in Japan only in certain places in Japan. Therefore, it is troublesome to attempt make use of such an effective bedrock bath. For example, a reservation must be secured several months in advance, and even if the reservation can be secured, the place of bedrock bath must be visited from far away on the day of reservation. Even knowing the excellent effects of bedrock baths, not every person can make use of it readily as a usual facility.

(Related Art)

Techniques for making facilities which can utilize bedrock bath that are effective in recovering and promoting health as described above more available have already been developed. Although the number of them is small, such proposals include, for example, that of "Stone Bath Devices" of Japanese Patent Provisional Publication No. 2001-95889 and of "Far Infrared Rays-Radiating Concrete Bodies" of Japanese Patent Provisional Publication No. 8-12406 (No. 12406/1996). These techniques are based on a substantially common technical concept that heating pipes capable of being heated by a boiler are embedded under the bottom surface of a room, and concrete bodies with which natural stone or materials capable of being irradiated with far infrared rays, such as natural stone, are mixed or gravel, sand, or the like is spread on the floor surface of room to warm the human body. It is known that the conventional facility using the already proposed techniques can achieve almost the same effect as that of hot bath utilizing natural bedrock lying in hot spring towns.

[Patent Document 1]

(1) Japanese Patent Provisional Publication No. 2001-95889

(2) Japanese Patent Provisional Publication No. 8-12406 (No. 12406/1996)

(Problems)

However, the conventional artificial hot bath facility having been developed and used practically for the above-described purpose is characterized in that the temperature control in the bathroom is carried out by hot-water supply using a boiler. In such a facility, hot water flowing so as to follow the route of heating pipes laid under the floor surface has a considerably large difference in temperature between the supply end and the discharge end. It is difficult to uniformly heat the interior of a large bathroom by using a hot-water supply system using underfloor pipes. Specifically, the temperature is too high or conversely too low depending on the position at which the user lies down, and it is very difficult to control the temperature to an optimum temperature over the whole of the bathroom. In order to carry out uniform and effective control to regulate the bedrock surface temperature, the room temperature, and the room humidity suitable for bedrock bath, the control worker must make an effort to always perform fine adjustment work by paying close attention, so that the labor burden on the control worker is too heavy. As a result, a problem of poor profitability remains unsolved.

OBJECT AND SUMMARY OF THE INVENTION (Object of the Invention)

The applicant of the present invention started research and development without delay to control the bedrock surface temperature and the temperature and humidity in the room as efficiently as possible. After a great deal of trial and error, and many test samples and experiments, the present applicant succeeded in realizing a hot bath facility having a new construction and a new control method for controlling the temperature and humidity. Hereunder, the details thereof will be described with reference to an example representing the present invention, which is shown in the accompanying drawings.

(Configuration of the Invention)

As is seen from an example representing the present invention, which is shown in the accompanying drawings, the hot bath facility in accordance with the present invention has a basic configuration as described below.

Lath materials such as wire mesh are combined with each other, floor heating pipes of at least two stages, upper and lower, provided in a serpentine form with a predetermined pitch are laid above the floor concrete in an enclosed bathroom, and a training wave concrete layer with which natural stone powder generating training wave energy is mixed is formed above the pipes via a protective concrete layer. In an appropriately divided space on the training wave concrete surface, a rough stone flat plate of an appropriate size, which is formed of natural stone generating training wave energy, is embedded substantially in a flush form. On the other hand, into at least each pipe of two stages, upper and lower, hot water whose temperature is regulated and controlled to a predetermined temperature can be supplied circulatingly from a respective dedicated boiler.

The hot bath facility in accordance with the present invention, having the above-described basic configuration, has a specific construction as described below. Lath materials such as wire mesh are combined with each other at the upper and lower stages or at the upper, middle, and lower stages, an upper-stage pipe and a lower-stage pipe of at least two stages, upper and lower, provided in a serpentine form with a predetermined pitch are laid above the floor concrete in an enclosed bathroom via a waterproof sheet and a heat insulator, and a training wave concrete layer with which natural stone powder generating training wave energy is mixed is formed above the pipes via a protective concrete layer. In an appropriately divided space on the training wave concrete surface, a rough stone flat plate of a size such that at least the chest portion, the waist portion, and the leg portion of a human body lying face up can be placed thereon at the same time, which is formed of natural stone generating training wave energy, is embedded substantially in a flush form. On the other hand, into at least each pipe of two stages, upper and lower, hot water whose temperature is regulated and controlled to a predetermined temperature can be supplied circulatingly from a respective dedicated boiler.

A more specific construction is as described below. Lath materials such as wire meshes are combined with each other at the upper and lower stages or at the upper, middle, and lower stages, an upper-stage pipe and a lower-stage pipe of at least two stages, upper and lower, provided in a serpentine form with a predetermined pitch are laid above the floor concrete in an enclosed bathroom via a waterproof sheet and a heat insulator, and a training wave concrete layer with which natural stone powder generating training wave energy is mixed is formed above the pipes via a protective concrete layer. In an appropriately divided space on the training wave concrete surface, a rough stone flat plate of a size such that at least the chest portion, the waist portion, and the leg portion of a human body lying face up can be placed thereon at the same time, which is formed of natural stone generating training wave energy, is embedded substantially in a flush form. On the other hand, into at least each pipe of two stages, upper and lower, hot water whose temperature is regulated and controlled to a predetermined temperature can be supplied circulatingly in the direction reverse to each other from a respective dedicated boiler.

A more favorable construction is as described below. Lath materials such as wire meshes are combined with each other at the upper and lower stages or at the upper, middle, and lower stages, an upper-stage pipe and a lower-stage pipe of at least two stages, upper and lower, provided in a serpentine form with a predetermined pitch are laid above the floor concrete in an enclosed bathroom via a waterproof sheet and a heat insulator, and a training wave concrete layer with which natural stone powder generating training wave energy is mixed is formed above the pipes via a protective concrete layer. In an appropriately divided space on the training wave concrete surface, a rough stone flat plate of a size such that at least the chest portion, the waist portion, and the leg portion of a human body lying face up can be placed thereon at the same time, which is formed of natural stone generating training wave energy, is embedded substantially in a flush form. Also, water supply gutters having a predetermined downward slope ranging from a water sprinkling nozzle to a water sprinkling path are formed on both sides of the rough stone flat plate embedded space, and wooden slats that do not hinder the sprinkling of water are laid in the water sprinkling path and the water supply gutters so as to be flush with the rough stone flat plate. On the other hand, into at least each pipe of two stages, upper and lower, hot water whose temperature is regulated and controlled to a predetermined temperature can be supplied circulatingly in the direction reverse to each other from a respective dedicated boiler, and the temperature and humidity in the bathroom can be controlled by the heating of the heat floor surface by the boiler and heat of vaporization due to water sprinkling to said water sprinkling path.

The hot bath facility in accordance with the present invention may be described by changing the expressions as described below. Lath materials such as wire mesh are combined with each other at the upper and lower stages or at the upper, middle, and lower stages, an upper-stage pipe and a lower-stage pipe of at least two stages, upper and lower, provided in a serpentine form with a predetermined pitch are laid above the floor concrete in an enclosed bathroom via a waterproof sheet and a heat insulator, and a training wave concrete layer with which natural stone powder generating training wave energy is mixed is formed above the pipes via a protective concrete layer. A water sprinkling path with a predetermined width and a predetermined downward slope from one end to the other end of the enclosed bathroom is concavely provided near the center of the training wave concrete surface, and a plurality of rough stone flat plate embedded spaces each formed of a rough stone flat plate embedded substantially in a flush form are arranged on both sides of the water sprinkling path, the rough stone flat plate having a size such that at least the chest portion, the waist portion, and the leg portion of a human body lying face up can be placed thereon at the same time and being formed of natural stone generating training wave energy. Also, water supply gutters having a predetermined downward slope ranging from a water sprinkling nozzle to the water sprinkling path are formed on both sides of each of the rough stone flat plate embedded spaces, and wooden slats that do not hinder the sprinkling of water are laid in the water sprinkling path and the water supply gutters so as to be flush with the rough stone flat plate. On the other hand, into at least each pipe of two stages, upper and lower, hot water whose temperature is regulated and controlled to a predetermined temperature can be supplied circulatingly in the direction reverse to each other from a respective dedicated boiler, and the temperature and humidity in the bathroom can be controlled by the heating of the heat floor surface by the boiler and heat of vaporization due to water sprinkling to said water sprinkling path.

The hot bath facility in accordance with the present invention may be described more specifically by changing the expression as described below. Lath materials such as wire mesh are combined with each other at the upper and lower stages or at the upper, middle, and lower stages, an upper-stage pipe and a lower-stage pipe of at least two stages, upper and lower, provided in a serpentine form with a predetermined pitch are laid above the floor concrete in an enclosed bathroom via a waterproof sheet and a heat insulator, and a training wave concrete layer with which natural stone powder generating training wave energy is mixed is formed above the pipes via a protective concrete layer. A water sprinkling path with a predetermined width and a predetermined downward slope in a longitudinal cross section from one end to the other end of the enclosed bathroom is concavely provided near the center of the training wave concrete surface, and a plurality of rough stone flat plate embedded spaces each formed of a rough stone flat plate embedded substantially in a flush form are arranged on both sides of the water sprinkling path, the rough stone flat plate having a size such that a person can lie down with the head or the foot directed toward the water sprinkling path and at least the chest portion, the waist portion, and the leg portion of a human body lying face up can be placed thereon at the same time and being formed of natural stone generating training wave energy. Also, water supply gutters having a predetermined downward slope ranging from a water sprinkling nozzle to the water sprinkling path are formed on both sides of each of the rough stone flat plate embedded spaces, and wooden slats that do not hinder the sprinkling of water are laid in the water sprinkling path and the water supply gutters so as to be flush with the rough stone flat plate. On the other hand, into at least each pipe of two stages, upper and lower, hot water whose temperature is regulated and controlled to a predetermined temperature can be supplied circulatingly in the direction reverse to each other from a respective dedicated boiler, and the temperature and humidity in the bathroom can be controlled by the heating of the heat floor surface by the boiler and vaporization due to water sprinkling to said water sprinkling path.

(Related Inventions)

In relation to the above-described hot bath facility, the present invention embraces a temperature and humidity control method capable of properly controlling the temperature and humidity of the hot bath facility. The basic configuration thereof is as described below.

In a temperature and humidity control method for the hot bath facility as described in any of the above-described inventions, the floor surface in the enclosed bathroom is heated by circulatingly supplying hot water whose temperature is regulated and controlled to a predetermined temperature from the respective dedicated boiler to the pipes of two stages, upper and lower, so that the temperature of an exposed surface of the rough stone flat plate embedded space becomes about 50 to 65° C. and the room temperature becomes 40 to 45° C., and the humidity in the room is kept at about 65 to 95% by appropriately sprinkling water in said enclosed bathroom. When the temperature of the exposed surface of the rough stone flat plate embedded space exceeds 65° C. or when the room temperature exceeds 45° C., water is sprinkled again in the bathroom and hence the rough stone flat plate embedded space and the interior of bathroom are cooled to regulate the temperature. Thereby, the temperature and humidity in the rough stone flat plate embedded space and bathroom are controlled continuously.

The temperature and humidity control method having the basic configuration is described more specifically below. In a temperature and humidity control method for the hot bath facility as described in any of the above-described inventions, the floor surface in the enclosed bathroom is heated by circulatingly supplying hot water whose temperature is regulated and controlled to a predetermined temperature from the respective dedicated boiler to the pipes of two stages, upper and lower, so that the temperature of exposed surface of rough stone flat plate embedded space becomes about 50 to 65° C., preferably 50° C., and the room temperature becomes 40 to 45° C., preferably 42° C., and the humidity in the room is kept at about 65 to 95%, preferably 90%, by releasing an appropriate amount of water from the water sprinkling nozzle through the water supply gutter and water sprinkling path. When the temperature of exposed surface of rough stone flat plate embedded space exceeds 65° C. or when the room temperature exceeds 45° C., an appropriate amount of water is released from the water sprinkling nozzle through the water supply gutter and water sprinkling path and hence the rough stone flat plate embedded space and the interior of bathroom are cooled to regulate the temperature. Thereby, the temperature and humidity in the rough stone flat plate embedded space and bathroom are controlled continuously.

More specifically, in a temperature and humidity control method for the hot bath facility as described in any of the above-described inventions, the floor surface in the enclosed bathroom is heated by circulatingly supplying hot water whose temperature is regulated and controlled to a predetermined temperature from the respective dedicated boiler to the pipes of two stages, upper and lower, so that the temperature of exposed surface of rough stone flat plate embedded space becomes about 50 to 65° C., preferably 50° C., and the room temperature becomes 40 to 45° C., preferably 42° C., and the humidity in the room is kept at about 65 to 95%, preferably 90%, by sprinkling water appropriately in the bathroom. Air blowing fans provided on the ceiling of bathroom are always driven to agitate air in the bathroom to provide a uniform temperature and humidity. When the temperature of exposed surface of rough stone flat plate embedded space exceeds 65° C. or when the room temperature exceeds 45° C., water is again sprinkled in the bathroom and hence the rough stone flat plate embedded space and the interior of bathroom are cooled to regulate the temperature, and when the temperature detector detects a room temperature of 45° C. or more, the exhaust fan and the outside air suction fan are simultaneously started, and the in operation is continued for a predetermined period of time or until the room temperature decreases to about 42° C. Thereby, the temperature and humidity in the rough stone flat plate embedded space and bathroom are controlled continuously 24 hours a day.

As described above, according to the hot bath facility in accordance with the present invention, first of all, a construction is provided in which hot water that is regulated and controlled individually is supplied by connecting the respective dedicated boiler to each of the pipes of two stages, upper and lower, embeddedly provided under the floor surface. Therefore, the vertically wide (thick) range under the floor surface can be heated uniformly as compared with the conventional facility in which the pipe is embedded at one stage. The whole of the floor surface in the enclosed bathroom can be heated uniformly, and the floor surface temperature can be stabilized. In addition, the influence of cooling due to heat dissipation to the outside is reduced by increasing the heat capacity, and a stable floor surface temperature can always be kept without being subjected to an influence due to the fluctuations in outside temperature caused by changes in season, daily climate changes, etc. Therefore, a hot bath environment which undergoes a small temperature change and is always fixed can be provided to the user, and the effect of recovering and promoting health can be enhanced by a lot of training wave energy generated from the rough stone flat plate and the training wave concrete layer. Further, because the fuel consumption of the boiler is reduced, a feature of being economical and ecologically friendly can be obtained.

Also, according to the temperature and humidity control method for the hot bath facility in accordance with the present invention, the floor surface in the enclosed bathroom is heated by supplying hot water from the respective dedicated boiler to the pipes of two stages, upper and lower, so that the temperature of the exposed surface of the rough stone flat plate embedded space becomes about 50 to 65° C. and the bathroom temperature becomes 40 to 45° C. When the temperature of the exposed surface of the rough stone flat plate embedded space and their bathroom temperature increase excessively beyond the respective target temperature ranges, water is released through the water sprinkling nozzle, by which the temperature of the exposed surface of the rough stone flat plate embedded space and the bathroom temperature are decreased by heat of vaporization and converge to their respective target temperature ranges, and also the humidity in the bathroom is controlled so as to be about 65 to 95%. Thereby, temperature and humidity control in the enclosed bathroom can be carried out easily and stably, and continuous control for 24 hours a day can be carried out with relative ease. Further, when the temperature detector detects a bathroom temperature exceeding 45° C., the exhaust fan and the outside air suction fan are started simultaneously, and their operation is continued for a predetermined period of time or until the room temperature decreases to about 42° C., so that the air in the bathroom is exchanged with outside air automatically and forcibly. Therefore, the temperature and humidity in the bathroom is controlled more closely by combining water sprinkling with ventilation, which achieves an excellent effect of providing a comfortable hot bath environment.

BRIEF DESCRIPTION OF THE DRAWINGS

The drawings show a typical example that embodies a technical concept of a hot bath facility and a temperature and humidity control method in accordance with the present invention.

DETAILED DESCRIPTION OF PREFERRED EMBODIMENTS

Figure 1:
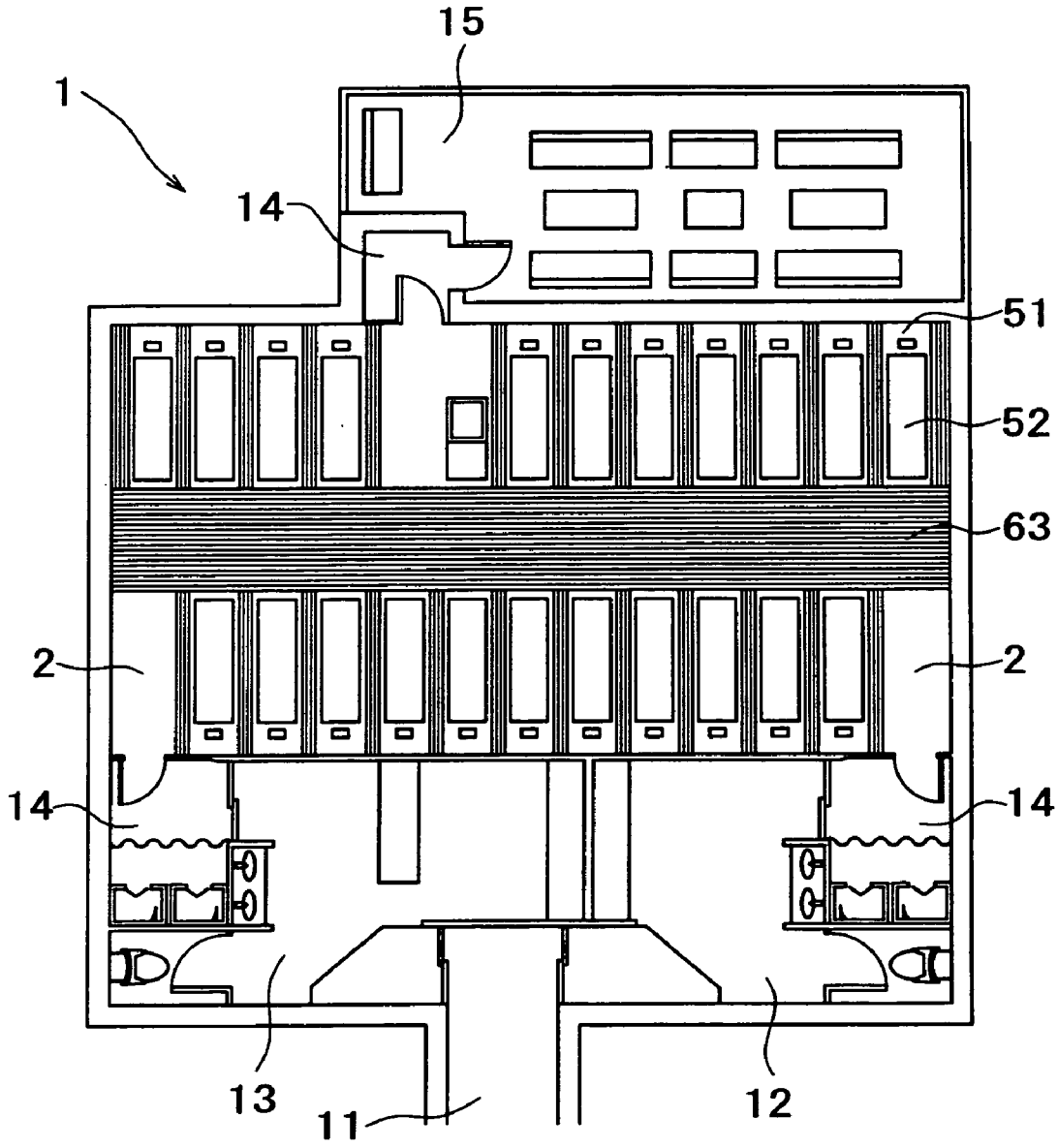
FIG. 1 is a plan view showing an internal construction of a hot bath facility.

A best or preferred mode in carrying out the present invention configured as described above will be explained below.

First, an enclosed bathroom must have a construction such as to perform a function such that the interior of a hot bath facility can be held in an enclosed form, the temperature and humidity in the bathroom can be regulated and controlled properly, and the user can go in and out of the bathroom freely, and to secure high thermal retention by means of increased heat insulating properties and be capable of keeping humidity. Doors for doorways, windows, etc. must have a sealing construction such as to be closed sealingly, and a knob or handle capable of being locked easily must be provided. A wind shut-off room is preferably provided at each of doorways to prevent a sudden temperature change occurring when the user goes in and out of the bathroom. Also, air blowing fans for agitating air in the room are provided at a plurality of appropriate places on the ceiling of the bathroom, and a temperature detector capable of detecting the rise in room temperature is provided at an appropriate place in the room. On the wall surface near the ceiling, an outside air suction fan capable of being operated in association with the temperature detector is provided, and on the opposite wall surface, an exhaust fan capable of being operated in association with the temperature detector is provided so as to be opposed to the outside air suction fan. Further, near the substantially central portion on the floor surface, there is formed a box having a predetermined volume, which is made of training wave concrete to which natural stone powder generating training wave energy is added or natural stone generating training wave energy, to provide a humidity controlling vessel which has an automatic water supply mechanism, opens the water surface to the room, and can heat the stored water by being supplied with heat from the floor surface. The humidity can be regulated automatically by water evaporated from the vessel, and the room temperature can also be regulated finely by sprinkling water drawn up from the vessel using a sprinkling can.

Floor concrete supports underfloor structures for the enclosed bathroom from underneath and provides a foundation for the whole of the floor surface. Also, it enhances heat retention and heat insulating properties, and performs a function of reducing the dissipation of heat to the ground or the lower floor. It is preferable that a waterproof sheet, a heat insulator, etc. be held between the floor concrete and a protective concrete layer to improve the moisture proofing properties and heat insulating properties. In the case where the enclosed bathroom is provided on a ground floor or a basement, it is preferable that a rubble bed be installed by placing a moisture proof sheet in a lower layer of the floor concrete, and the floor concrete be directly brought into contact with the ground or the base under the ground to enhance heat retention. Like a training wave concrete layer, the floor concrete can be formed of concrete to which natural stone powder generating training wave energy is added.

Floor heating pipes are embeddedly provided under the floor of the enclosed bathroom, and perform a function of heating the floor surface to raise the temperature in the bathroom by being supplied with hot water from a boiler. The heating pipes must be configured so as to be installed at two stages, upper and lower, be laid in a serpentine form with a predetermined pitch under the floor surface, and be connected with a respective dedicated boiler. Lath materials such as wire mesh at the upper and lower stages or at the upper, middle, and lower stages should be combined and embedded in the protective concrete layer to integrate the upper-side training wave concrete layer with the lower-side floor concrete and to prevent cracking, sedimentation, and deformation by increasing the strength of the entire structure. It is preferable that pipes of two stages, upper and lower, be installed so as to be supplied with hot water in reverse directions from dedicated boilers. To ensure uniform heating, as in the example described later, pipes with an outside diameter of about 20 mm and an inside diameter of about 16 mm are laid in a serpentine form with a pitch of about 150 mm, and are installed so that the adjacent intervals between the upper- and lower-stage pipes are substantially uniform. Furthermore, the pipes of two stages, upper and lower, are preferably arranged in a serpentine form so as to cross each other at a plurality of locations.

The boilers perform a function of being capable of circulatingly supplying hot water whose temperature is regulated and controlled to a predetermined temperature to the pipes, by which the floor surface in the enclosed bathroom can be heated to a desired temperature. The boiler dedicated to the upper-stage pipe and the boiler dedicated to the lower-stage pipe are provided. These boilers must be configured so as to heat water by burning any of various fuels such as kerosene, heavy oil, pulverized coal, and gas, or by using electric power etc., and to be capable of being used in any place. Moreover, a spare tank capable of storing a predetermined amount of supply water should be provided to enable steady operation by supplying water of a fixed pressure. Furthermore, the construction is preferably such that water from the spare tank is supplied to a water sprinkling nozzle and a humidity controlling vessel so that the control of temperature in the enclosed bathroom is not affected by the fluctuations in pressure of city water.

The protective concrete layer performs the functions of arranging the floor heating pipes laid in a serpentine form at two stages, upper and lower, so as to fix them at set positions between the floor concrete and the training wave concrete layer, transmitting heat efficiently to the training wave concrete layer, and preventing the embedded pipes from being compressed and deformed by a load applied to the floor surface of the enclosed bathroom. The protective concrete layer must have a strength approximately equal to that of ordinary concrete, and must secure a sufficient strength by combining the lath materials such as wire mesh and be integrated with the floor concrete and the training wave concrete. The protective concrete layer can be formed of concrete with which ordinary aggregate is mixed, and can further be formed of concrete with which natural stone or rubble thereof generating training wave energy is mixed.

The training wave concrete layer generates training wave energy like a rough stone flat plate though forming an ordinary concrete layer in appearance, and performs a function of fixedly and integrally holding the rough stone flat plate embedded so as to be flush with the floor surface in the enclosed bathroom. The training wave concrete layer must be formed of concrete with which an appropriate amount of natural stone powder generating training wave energy is mixed, and should be formed over the substantially whole surface including at least a rough stone flat plate embedded space of the floor surface in the enclosed bathroom, preferably including a water sprinkling path, a supply water gutter, etc. The training wave concrete layer can be formed so that the lower surface of the rough stone flat plate is in contact with the training wave concrete layer or is in contact with the top surface of the protective concrete layer.

The rough stone flat plate embedded space is divided into a predetermined size on the training wave concrete layer, and is formed so that the rough stone flat plate of a predetermined size, which is formed of natural stone generating training wave energy, is embedded in a flush form at an appropriate place to perform a function of securing a space suitable for hot bath. The rough stone flat plate embedded space is a space divided so as to have lengthwise and width dimensions such that one person or a plurality of persons can lie face up, and should be formed as described below. One or a plurality of rough stone flat plates are provided which have a size and arrangement such that at least the chest portion, the waist portion, and the leg portion can be placed at the same time. At a place where the rough stone flat plate is not embedded in the space, the training wave concrete must be exposed. At the places corresponding to the chest portion, the waist portion, and the leg portion, one tile-form rough stone flat plate with a diameter of about 20 to 30 cm can be embedded at the right and left or in the center. Besides, in the range of a width of about 35 cm and a depth of about 140 cm corresponding to the chest portion, the waist portion, and the leg portion, one rough stone flat plate or rough stone flat plates divided into a plurality of sheets can be laid. Further, at a place corresponding to the head, a pillow-form rough stone plate can be disposed.

The natural stone must be such that at least the natural stone itself generates far infrared rays with a wavelength of 3 to 25 μm, preferably 4 to 14 μm, and must have properties of generating training wave energy that is good for health, for example, activates the cells of human body or improves the circulation of the blood. In other words, the natural stone must have properties of generating very weak vibration energy or weak magnetic energy and stimulating the cells in the human body to assist in the improvement of physical constitution and recovery from exhaustion, and achieving various effects of beautiful skin, weight loss, and prevention of chronic fatigue, lower-back pain, stiff shoulders, cold, etc. The natural stone, may specifically include hornblende (produced in Iwate Prefecture), tenteiseki (produced in Miyazaki Prefecture), tourmaline (produced in Brazil), violet quartz (produced in Brazil), and quartz (produced in Brazil). The rough stone flat plate is a flat plate with a predetermined area and a predetermined thickness, which is cut from such natural stone.

The water sprinkling path, which is concavely provided so that sprinkled water can be guided and allowed to flow to an appropriate place on the floor surface of the enclosed bathroom, performs a function such that sprinkled water is evaporated by heat supplied from under the floor to increase the humidity in the room, and the surface temperature of the training wave concrete layer and rough stone flat plate and the room temperature that have risen excessively are decreased, by which the temperature and humidity can be controlled. The area of water sprinkling path should be secured according to the floor area, the room volume of the enclosed bathroom, and the heating capacity of floor heating. It is preferable that wooden slats that do not hinder the flowing-down of sprinkled water be provided in the water sprinkling path so as to be flush with the rough stone flat plate. The construction should be such that all sprinkled water is heated and evaporated in the process of flowing from the upstream side to the downstream side. However, some of sprinkled water can be discharged to the outside of the enclosed bathroom through a discharge path provided on the downstream side.

The water supply gutter can sprinkle water along both sides of the rough stone flat plate embedded space, and performs functions of decreasing the surface temperature of the rough stone flat plate to lower the temperature in the enclosed bathroom, and evaporating some or whole of sprinkled water by supplying heat from under the floor to increase the humidity in the enclosed bathroom. The water supply gutter must be concavely provided along both sides of the rough stone flat plate embedded space so as to have a predetermined width and a predetermined slope. It must be arranged so as to slope downward toward the water sprinkling path, and wooden slats that do not hinder the sprinkling of water are preferably provided in the water supply gutter so as to be flush with the rough stone flat plate.

The humidity controlling vessel is constructed so that the vessel itself generates training wave energy, and moreover can store a predetermined volume of water. In the humidity controlling vessel, some of stored water is evaporated by heat supplied from under the floor, by which the functions of increasing the humidity in the enclosed bathroom and decreasing the temperature therein is automatically performed. The humidity controlling vessel should be formed of natural stone generating training wave energy or formed of concrete containing powder of the natural stone. If necessary, an automatic water supply mechanism is preferably incorporated to always store a fixed amount of water.

In the temperature and humidity control method for the hot bath facility, the control worker can carry out control by manually controlling the temperature of hot water supplied from the dedicated boiler, the operation of water supply valve, the operation of sprinkling from the water sprinkling nozzle, and fine adjustment of air blowing fans and suction and exhaust fans while checking the temperature of exposed surface of each rough stone flat plate embedded space and the room temperature in the enclosed bathroom, and the humidity in the room. In addition, the control can be carried out by feedback control based on the detection values sent from various temperature sensors and humidity sensors, or the control can be carried out using an automatic control unit in which sequence control is carried out based on a predetermined control program. Also, only at night, when the control worker is absent, the control work for the temperature and humidity in the bathroom can be entrusted to the automatic control unit, or some work such as circulation of air in the enclosed bathroom or ventilation can be performed by the automatic control unit.

As a result, the control mode can be switched over between automatic control and manual control appropriately according to the user's request due to individual liking such that the temperature is too high or too low or the control worker's convenience. Further, floor heating pipes are installed for each rough stone flat plate embedded space or for each group of rough stone flat plate embedded spaces to carry out temperature control individually, by which temperature areas of high temperature, medium temperature, low temperature, etc. are formed so that the user can select the temperature area freely according to his/her liking. Also, the water sprinkling nozzle can be opened and closed individually to carry out control so that the user's needs can be met individually. Further, an operation valve for water sprinkling nozzle can be provided for each rough stone flat plate embedded space so that the user himself/herself can regulate the temperature.

Hereunder, the construction of the hot bath facility will be described in detail with reference to an example representing the present invention, which is shown in the accompanying drawings.

EXAMPLE 1

Figure 2:
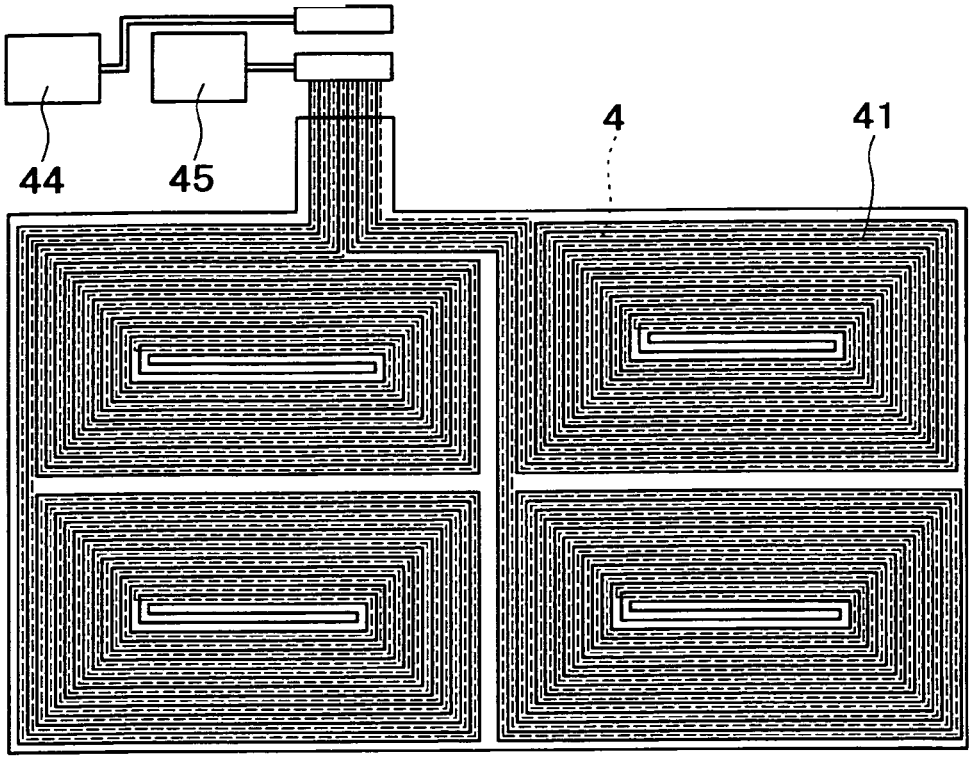
FIG. 2 is a plan view showing a piping construction of pipes of two stages, upper and lower.
Figure 3:
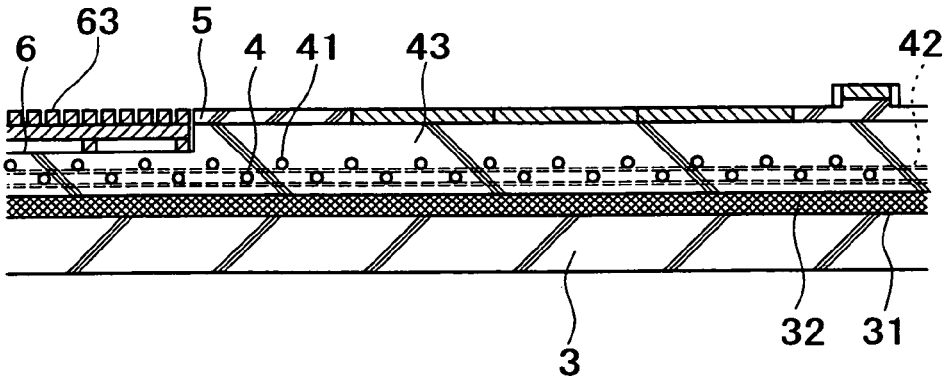
FIG. 3 is a side view showing a longitudinal cross section of an underfloor construction.
Figure 4:
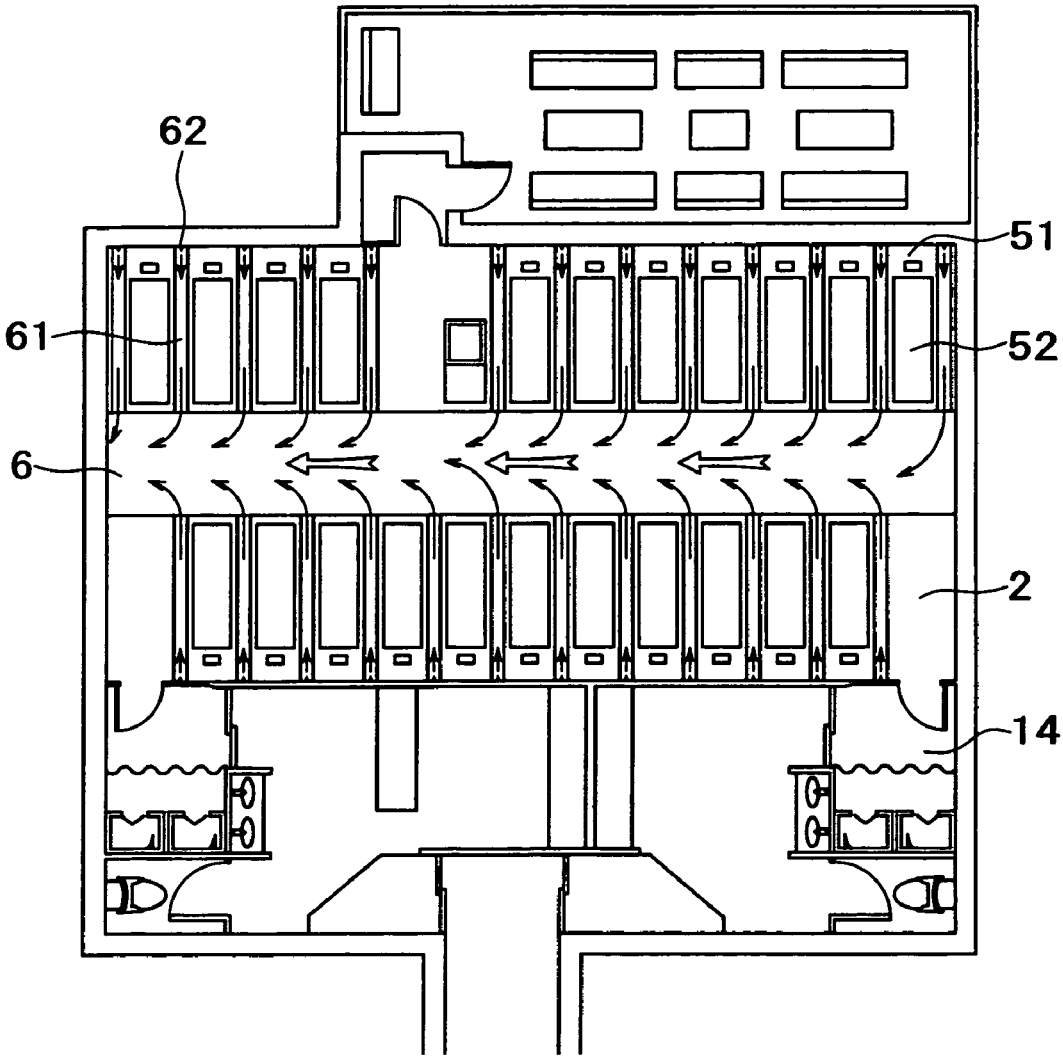
FIG. 4 is a plan view showing an arrangement of a water sprinkling path and water supply gutters.
Figure 5:
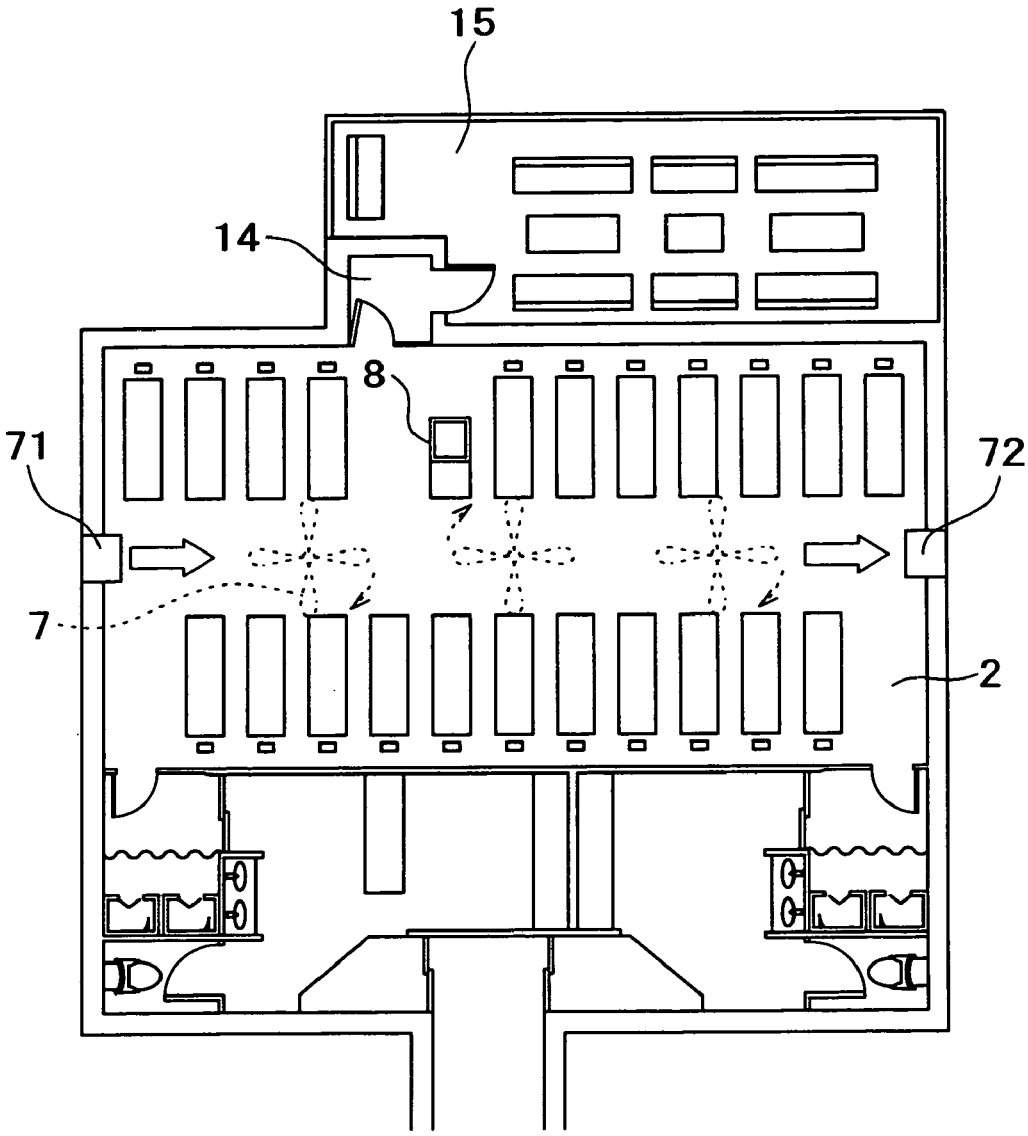
FIG. 5 is a plan view showing an arrangement of air blowing fans and suction and exhaust fans for an enclosed bathroom.
Figure 6:
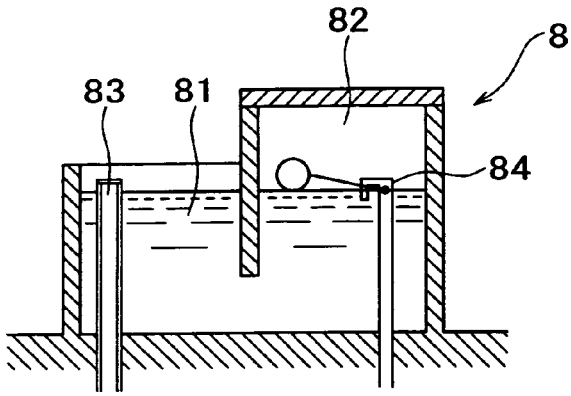
FIG. 6 is a side view showing a longitudinal cross section of a humidity controlling vessel.

FIG. 1 is a plan view of the interior of a hot bath facility, FIG. 2 is a plan view of heating pipes, FIG. 3 is a side view showing a longitudinal cross-section of an underfloor construction, FIG. 4 is a plan view of a sprinkling path and water supply gutters, FIG. 5 is a plan view of air blowing fans and suction and exhaust fans for an enclosed bathroom, and FIG. 6 is a side view showing a longitudinal cross section of a humidity controlling vessel. An example shown in these figures is one typical example of the hot bath facility in accordance with the present invention.

The basic construction of this hot bath facility 1 is as described below. Pipes 41 and 4 of two stages, upper and lower, are laid above floor concrete 3 in an enclosed bathroom 2, and a training wave concrete layer 5 is formed above the pipes 41 and 4 via a protective concrete layer 43. In an appropriately divided space 51 on the surface of the training wave concrete layer 5, a rough stone flat plate 52 is embedded substantially in a flush form. On the other hand, into the pipes 41 and 4 of two stages, upper and lower, hot water whose temperature is regulated and controlled to a predetermined temperature can be supplied circulatingly from respective dedicated boilers 44 and 45.

The training wave concrete layer 5 is made by mixing natural stone powder generating training wave energy, and the rough stone flat plate 52 is made of natural stone generating training wave energy.

The hot bath facility 1 is one step higher than an entrance 11, and is provided with locker rooms 12 and 13 for male and female, on either side, right and left, to which the user goes after taking off his/her shoes or slippers, so that the user goes in the enclosed bathroom 2 from each of the locker rooms 12 and 13 through a separate wind shut-off room 14, 14. At a position on the opposite side of the enclosed bathroom 2, a cooling-off place 15 in the open air is provided via one wind shut-off room 14.

The enclosed bathroom 2 is formed into a rectangular shape measuring about 12 m in width by about 5.5 m in depth, and the height thereof from the floor top surface to the ceiling lower surface is set at about 3 m. The underfloor construction of the enclosed bathroom 2 has, as shown in FIG. 3, the floor concrete 3 provided at the lowest position, a waterproof sheet 31 and a heat insulator 32 with a thickness about 50 mm, which are laminated in succession on the floor concrete 3, a wire mesh 42, which is a lath material provided in a layer above the heat insulator 32, the lower-stage heating pipe 4 provided on the wire mesh 42, a wire mesh 42 further laid above the lower-stage pipe 4, the upper-stage heating pipe 41 provided on the wire mesh 42, a protective concrete layer 43 in which the upper and lower wire meshes 42 and the upper- and lower-stage pipes 41 and 4 are embedded, and the training wave concrete layer 5 provided above the protective concrete layer 43.

The floor concrete 3 is slab concrete with a thickness of about 120 mm provided on a rubble bed formed on the ground so as to have a thickness of about 120 mm with a moisture proof sheet being held there between. The lower-stage heating pipe 4 is arranged so that a pipe with an outside diameter of about 20 mm and an inside diameter of about 16 mm are laid in a serpentine form with a pitch of about 150 mm. The upper-stage heating pipe is arranged so that a pipe with the same dimensions as those of the lower-stage pipe is laid in a serpentine form with a pitch of about 150 mm in such a manner that the interval between the upper- and lower-stage pipes is about 75 mm. The piping form of the upper and lower pipes 41 and 4 is not limited to a serpentine form, and may be a spiral form in plan view.

The protective concrete layer 43 is formed into a layer with a thickness of about 110 mm above the floor concrete 3 by placing concrete so that the upper and lower wire meshes 42, 42 and the upper- and lower-stage pipes 41 and 4 are embedded. The training wave concrete layer 5 is formed by being placed so that powder of hornblende (granite produced in Iwate Prefecture), which is used as natural stone generating training wave energy, is mixed with cement in a proportion of about 15 kg per 1 square meter and is kneaded to form mortar with a thickness of about 90 mm. The heating pipes may be installed in a serpentine form at three stages, upper, middle, and lower, according to the area etc. of the enclosed bathroom 2, and the wire meshes can also be installed at three stages, upper, middle, and lower, according to the number of stages of pipes.

The pipes 41 and 4 of two stages, upper and lower, are embeddedly provided under the floor surface of the enclosed bathroom 2 as shown in FIG. 2. The lower-stage pipe 4 indicated by a broken line in the figure is connected with the boiler 44 dedicated to the lower-stage pipe, and the upper-stage pipe 41 indicated by a solid line in the figure is connected with the boiler 45 dedicated to the upper-stage pipe, so that hot water whose temperature is regulated and controlled to a predetermined temperature is supplied by the individual dedicated boilers so as to flow in the opposite direction in the adjacent upper- and lower-stage pipes 41 and 4.

The upper-stage pipe 41 and the lower-stage pipe 4 are arranged by being shifted in the horizontal direction in such a manner that the main portions thereof are not lapped vertically on each other, and hence these pipes are configured so as to heat the whole of floor surface substantially uniformly.

FIG. 2 shows the pipes 41 and 4 of two stages, upper and lower, arranged in a serpentine form so as to be parallel with each other. However, the pipes 41 and 4 of two stages, upper and lower, can be arranged in a serpentine form so as to cross each other at a plurality of locations. The winding directions of the pipes 41 and 4 may be clockwise or counterclockwise.

As shown in FIG. 4, substantially in the center in the depth direction of the enclosed bathroom 2, a water sprinkling path 6 with a width of about 900 mm and a depth of about 150 mm is concavely provided so as to have a gentle downward slope ranging from one end to the other end in the width direction of the enclosed bathroom 2. On both sides of this water sprinkling path 6, a plurality of rough stone flat plate embedded spaces 51, 51, . . . divided so as to have a size of about 1800 mm or about 2100 mm in length and about 900 mm in width are formed in a range excluding the doorways of the wind shut-off rooms 14, 14, 14 so that a person can lie face up with the head directed to the outside in the depth direction of the bathroom 2 and the legs directed to the water sprinkling path 6.

Each of the rough stone flat plate embedded spaces 51, 51, . . . is configured as described below. In a range in which the chest portion, waist portion, and leg portion of a person lying face up can be can be placed, near the center of the space 51, a rough stone flat plate 52 measuring about 1400 mm in length by about 350 mm in width by about 20 to 100 mm in thickness, which is cut from hornblende serving as natural stone generating training wave energy, is embedded in a flush form. Alternatively, three rough stone flat plates 52 each measuring about 470 mm in length by about 350 mm in width by about 20 to 100 mm in thickness are embedded in a flush form over a range corresponding to the chest portion to the leg portion. Furthermore, at a place corresponding to the head of a person lying face up, a rimmed wooden pillow made of hornblende is fixed so as to project about 50 mm from the floor surface.

On both sides of each of the rough stone flat plate embedded spaces 51, 51, . . . , water supply gutters 61, 61, . . . each measuring about 200 mm in width by about 100 mm in depth are concavely provided so as to have a gentle downward slope from the wall surface of the enclosed bathroom 2 toward the water sprinkling path 6. At the ends on the wall surface side of the water supply gutters 61, 61, . . . on the opposite side to the water sprinkling path 6, water sprinkling nozzles 62, 62 . . . are provided. Each of the water sprinkling nozzles 62, 62, . . . can be opened and closed using an opening/closing valve, not shown, provided at an appropriate place in the enclosed bathroom 2 or at an appropriate place outside the bathroom 2. In the water sprinkling path 6 and the water supply gutters 61, 61, . . . , as shown in FIG. 1, a floor surface flush with the rough stone flat plate embedded space 51, 51, . . . is formed, and wooden slats 63 that do not hinder the flow of water supplied to the water sprinkling path 6 and the water supply gutters 61, 61, . . . are provided.

On the ceiling of the enclosed bathroom 2, as indicated by a broken line in FIG. 5, three air blowing fans 7, 7, 7 are provided at substantially equal intervals along the width direction of the enclosed bathroom 2 so that the air in the room is agitated forcibly by these air blowing fans 7. On the side wall at one end of the enclosed bathroom 2 near the ceiling, an outside air suction fan 71 is provided, and on the side wall on the other end on the opposite side near the ceiling, an exhaust fan 72 is provided. A temperature detector, not shown, such as a thermostat is further provided at an appropriate place in the enclosed bathroom 2 so that when the room temperature exceeds 45° C., the outside air suction fan 71 and the exhaust fan 72 are automatically started, and when the room temperature becomes about 42° C., the outside air suction fan 71 and the exhaust fan 72 are automatically stopped.

At a place close to the center of the enclosed bathroom 2 near the wind shut-off room 14 which is a doorway to the cooling-off place 15, a humidity controlling vessel 8 having a cross-sectional construction shown in FIG. 6 is provided. This humidity controlling vessel 8 is made of the same material as that of the training wave concrete layer 5, and is formed into a box shape projecting from the floor surface integrally with the training wave concrete layer 5. The humidity controlling vessel 8 consists of a humidifying tank 81 whose top surface is open and a water storage tank 82 whose top surface is closed, which communicates with the humidifying tank 81 so that water passes therebetween in the bottom portion. In the humidifying tank 81, a water discharge tube 83 capable of regulating the upper limit of water level is erected, and in the water storage tank 82, an automatic water supply mechanism 84 having a float for automatically opening and closing a water supply valve, not shown, according to a change in water level is provided.

Figure 7:
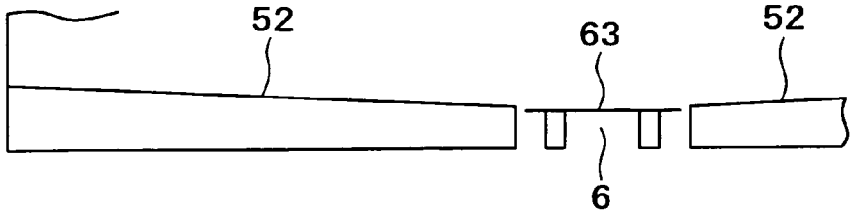
FIG. 7 is a side view schematically showing a state in which a rough stone flat plate is provided.
Figure 8:
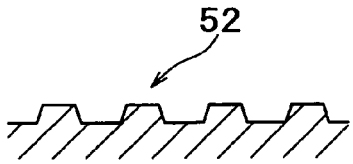
FIG. 8 is a side view showing a longitudinal cross section of the upper surface of a part of rough stone flat plate.

On the other hand, as shown in FIG. 7, the rough stone flat plate 52 in each of the rough stone flat plate embedded spaces 51 is provided so as to have a gentle downward slope (for example, 1/100 to 1.5/100) from the wall surface of the enclosed bathroom 2 toward the water sprinkling path 6. Therefore, a person can lie face up or face down in a comfortable position, and also the cleaning work can be performed easily. Also, on the upper surface of the rough stone flat plate 52, as shown in FIG. 8, a rugged portion having a height of about 1 mm, which extends in the width direction of the enclosed bathroom 2 with a fixed width dimension, is formed from the wall surface of the enclosed bathroom 2 toward the water sprinkling path 6. This rugged portion increases the strength of the rough stone flat plate 52, and allows water drops and sweat from a human body to smoothly flow into the water supply gutters 61 and the water sprinkling path 6.

(Operation of Example)

In the hot bath facility 1 relating to the example of the present invention having a configuration as described above, the temperature and humidity of the enclosed bathroom 2 is properly controlled by a temperature and humidity control method described below so as to be a temperature and humidity suitable for hot bath.

First, when the heating of the enclosed bathroom 2 is started, the dedicated boilers 44 and 45 are started operating.

Thereby, water is supplied individually to the pipes 41 and 4 of two-stages, upper and lower, which are indicated by the solid line and broken line as shown in FIG. 2, in the reverse direction in the adjacent pipes, by which the whole of floor surface is heated substantially uniformly. The whole of the floor surface is heated gradually over several days to about one week, and the temperature of exposed surface of the rough stone flat plate embedded space 51 is stabilized at about 50° C. The dedicated boilers 44 and 45 are controlled for 24 hours without stopping so as to supply hot water continuously, and thereby the rough stone flat plate embedded space 51 is heated so that the temperature of the exposed surface thereof is always about 50° C.

Next, when the temperature in the enclosed bathroom 2 rises gradually and reaches about 42° C., as indicated by solid-line arrow marks in FIG. 4, water is released from all of the water sprinkling nozzles 62, 62, . . . at the same time little by little, and allowed to flow down slowly in the water supply gutters 61, 61, . . . Then, the water is released gradually in the water sprinkling path as indicated by outline type arrows to form a water flow film, and is evaporated by heat from the floor surface, by which the room humidity is increased to about 90%. When the room temperature exceeds 45° C., the same sprinkling is performed again to take heat of vaporization away from the floor surface, by which control is carried out so that the room temperature is lowered to about 42° C. and the humidity in the bathroom 2 is kept at about 90%.

Also, when the temperature in the enclosed bathroom 2 reaches about 42° C., the air blowing fans 7 provided on the ceiling surface of the bathroom 2 are turned in the direction indicated by broken-line arrow marks in FIG. 5 to uniformly agitate the air in the room so that a substantially equal temperature and humidity can be kept everywhere in the room. Further, when the temperature in the bathroom 2 exceeds 45° C., the temperature detector having detected this fact automatically starts the outside air suction fan 71 and the exhaust fan 72. Thereby, as indicated by outline type arrows in FIG. 5, fresh outside air is taken into the enclosed bathroom 2 forcibly, and the room air of almost the same amount as that of suction air is forcibly discharged to the outside of the room, by which the room temperature is decreased, and simultaneously ventilation is effected. When the temperature detector detects that the temperature in the bathroom 2 reaches 42° C., the outside air suction fan 71 and the exhaust fan 72 stop automatically, so that the temperature in the bathroom 2 is kept stab.

The humidity controlling vessel 8 always stores a fixed amount of water as shown in FIG. 6, and the stored water is subjected to heating from the floor surface. Therefore, water always evaporates from the exposed water surface of the humidifying tank 81, so that the humidity in the enclosed bathroom 2 is kept high. Also, in the case where the rough stone flat plate embedded space 51, 51, . . . is excessively heated locally, water can be drawn directly from the humidifying tank 81 using a sprinkling can and be sprinkled. The water lost by evaporation or drawing is automatically replenished through the automatic water supply mechanism 84, so that a fixed amount of stored water can be secured. Moreover, since the humidity controlling vessel 8 itself is formed of training wave concrete, it radiates training wave energy toward the surroundings thereof and the stored water.

Thus, the temperature and humidity in the enclosed bathroom 2 and the temperature etc. of the rough stone flat plate embedded space 51 can be continuously controlled properly 24 hours a day, so that the hot bath can be made use of always under the optimum conditions. Therefore, the user changes into clothes that allow sweating, such as a yukata (an informal cotton kimono) or a jersey, in the male or female locker room 12, 13 shown in FIG. 1, and goes in the enclosed bathroom 2 through the wind shut-off room 14, 14. Then, the user selects any one of the rough stone flat plate embedded spaces 51, 51, . . . , spreading a bath towel in a range including the rough stone flat plate 52, and lies face down on the bath towel to place the chest portion and the abdomen portion on the rough stone flat plate 52 and warm them for one minute to five minutes to activate the stomach and intestines. Thereafter, the user lies face up so that the back, the waist portion, and the leg portion are placed on the rough stone flat plate 52, and is warmed for about five to ten minutes while drinking mineral water taken from the outside to drip with sweat in large amounts. Subsequently, the user moves to the cooling-off place 15 after passing through the wind shut-off room 14, in which the temperature is kept at about 30° C., which is a temperature lower than that in the enclosed bathroom 2 and higher than the outside temperature, to prevent a sudden change in temperature from being given to the body. In the cooling-off place 15, the user takes a rest for some time while sitting on a bench. Before the body temperature cools down, the user goes again in the enclosed bathroom 2 through the wind shut-off room 14, and takes the same hot bath a couple of times in total. Thereby, waste matters, lipid peroxide, toxins such as heavy metals and agricultural chemicals, and the like are eliminated to the outside of body together with sweat, metabolism is activated, and the physical constitution is led to a healthy slightly alkaline constitution.

After many persons have taken a bath and dripped sweat, many kinds of bacteria and viruses may exist in the enclosed bathroom 2. However, the rough stone flat plate 52 itself and the hornblende (natural stone generating training wave energy) contained in the training wave concrete layer 5 have bactericidal and deodorizing action, that is, they decompose contaminants eliminated together with sweat and prevent the occurrence of offensive odor. Therefore, fungus and dirt do not adhere to the wall or floor surface, and hence the hygienic environment of the entire system including air in the enclosed bathroom 2 can be maintained. Moreover, during cleaning at night, after the interior of the enclosed bathroom 2 is sprayed with water and brushed, the release of water from the water sprinkling nozzles 62 is stopped, and the interior of the bathroom 2 is dried sufficiently by heating from the floor surface for a predetermined period of time, by which various bacteria and viruses are killed completely to provide for the next day's operation. Thereby, the deterioration in the enclosed bathroom 2 can be prevented, and hence the hot bath facility 1 can be made use of for long years in a state equivalent to the state at the time when it was constructed newly.

(Effects of Example)

In addition to the features of the hot bath facility having the basic configuration of the present invention mentioned before, the hot bath facility 1 having the configuration described in the example has effects as described below. As shown in FIGS. 1 and 4, a plurality of rough stone flat plate embedded spaces 51, 51, . . . are arranged on both sides of the water sprinkling path 6 running through in a substantially central portion of the enclosed bathroom 2, by which many persons can make use of the bath at the same time. Also, as shown in FIGS. 2 and 3, by embeddedly provided pipes 41 and 4 of two stages, upper and lower, under the floor, all of the rough stone flat plate embedded spaces 51, 51, . . . can be heated uniformly. Further, as shown in FIG.

4, water is released and sprinkled to the water sprinkling path 6 through the water sprinkling nozzles 62, 62, . . . and water supply gutters 61, 61, . . . provided on both sides of each of the rough stone flat plate embedded spaces 51, 51, . . . and still, by which all of the rough stone flat plate embedded spaces 51, 51, . . . are cooled in the same way, and moreover are humidified uniformly. Therefore, a user may select any of the rough stone flat plate embedded spaces 51, 51, . . . enjoy the same hot bath effects.

Furthermore, the water stored in the humidity controlling vessel 8 provided in the center of the enclosed bathroom 2 is always heated and evaporated, by which the humidity in the enclosed bathroom 2 is maintained, and excessive drying can surely be prevented. In addition, the wooden slats 63 are mounted in the water supply gutters 61 and the water sprinkling path 6 to eliminate the exposure of wet floor surface, and the whole of the floor surface is finished into a flat shape without a difference in height by making the rough stone flat plate embedded spaces 51, 51, . . . flush. Therefore, stumbling and falling while walking are prevented, and thus greater safety can be secured.

(Conclusion)

As described above, the hot bath facility and the temperature and humidity control method in accordance with the present invention can achieve the intended object by means of a new configuration thereof. By the construction in which the heating pipes are installed at two stages, upper and lower, under the floor, which construction imposes a relatively light economical burden at the time of construction work, the floor surface temperature and the room temperature and humidity in the enclosed bathroom can be controlled uniformly and in a considerably steady manner, and also the fuel consumption of boiler can be reduced by decreasing a heat loss, by which the hot bath facility can be made considerably more economical than the conventional hot bath facility. Moreover, since the efficiency of regulation and control work for temperature and humidity can be enhanced significantly, the burden of control work is eased and hence the cost can surely be reduced. The hot bath facility and the temperature and humidity control method in accordance with the present invention are expected to gain a high reputation from users who desire the recovery and promotion of health by taking a bath and the managers and operators of hot bath facilities who supply hot bath service to users, and therefore used widely.

The invention claimed is:

1. A hot bath facility comprising:

a bathroom formed by a floor and a plurality of walls extending upwardly from said floor, at least one of said plurality of walls having a plurality of water sprinkling nozzles associated therewith, the floor further comprising:

a walking surface formed by a plurality of slat members positioned such that water vapor may pass therethrough;

a water sprinkling path formed below said walking surface, portions of said water sprinkling path forming gutters having a downward slope extending from at least one of the plurality of walls, wherein water may flow from said plurality of nozzles to portions of said water sprinkling path along at least one of said gutters;

at least one training wave surface positioned between at least a pair of said plurality of gutters, said training wave surface having a rough stone plate embedded therein, said rough stone plate having a substantially similar slope to said gutters and dimensioned to substantially fit a human body lying in a supine position; and a concrete layer below said training wave surface and said water sprinkling path, said concrete layer having first and second stage pipes embedded therein;

the hot bath facility further comprising a boiler configured to supply a hot fluid to said first and second stage pipes for heating said concrete layer and said rough stone plate and for evaporating the water flowing from said plurality of nozzles to increase the humidity in said bathroom.

2. The hot bath facility of claim 1, wherein said bathroom further comprises a ceiling, said ceiling having at least one fan adapted thereto for circulating air in said bathroom.

3. The hot bath facility of claim 1, wherein at least one of the plurality of walls includes an outside air suction fan.

4. The hot bath facility of claim 3, wherein a wall opposite that of said at least one wall including said outside air suction fan includes an exhaust fan.

5. The hot bath facility of claim 4, wherein at least one of said plurality of walls includes a temperature detector configured to regulate the function of said outside air suction fan and said exhaust fan when the temperature of the enclosed bathroom exceeds a programmed temperature.

6. The hot bath facility of claim 1, wherein a box projects from said training wave concrete layer, said box comprising a humidifying tank and a water storage tank, said humidifying tank having an open top surface, said water storage tank having a closed top surface, wherein said humidifying tank is adapted to communicate with said water storage tank so that water may pass between said tanks.

7. The hot bath facility of claim 6, wherein water in the humidifying tank may be supplied with heat from said floor.

8. The hot bath facility of claim 7, wherein said box is made of training wave concrete to which natural stone generating training wave energy is added, said box further including an automatic water supply mechanism.

9. The hot bath facility of claim 1, wherein said first stage pipe and said second stage pipe are arranged in a serpentine form so as to cross each other at a plurality of locations.

10. The hot bath facility of claim 1, wherein said rough stone plate includes a rugged portion configured to allow waterdrops and sweat from a human body lying thereon to flow from said rough stone plate to said water sprinkling path.

* * * * *